US007871297B2

(12) United States Patent
Li

(10) Patent No.: US 7,871,297 B2
(45) Date of Patent: Jan. 18, 2011

(54) ELECTRICAL CONNECTOR ASSEMBLY

(75) Inventor: Xiu-Dong Li, Yingcheng (CN)

(73) Assignee: Lotes Co., Ltd., Keelung (TW)

( * ) Notice: Subject to any disclaimer, the term of this patent is extended or adjusted under 35 U.S.C. 154(b) by 240 days.

(21) Appl. No.: 12/165,994

(22) Filed: Jul. 1, 2008

(65) Prior Publication Data

US 2009/0311907 A1 Dec. 17, 2009

(30) Foreign Application Priority Data

Jun. 11, 2008 (CN) ..... 2008 2 0115480 U

(51) Int. Cl.
*H01R 13/648* (2006.01)

(52) U.S. Cl. ..... 439/607.54; 439/353

(58) Field of Classification Search ..... 439/350–358, 439/607.54
See application file for complete search history.

(56) References Cited

U.S. PATENT DOCUMENTS 6,074,222 A * 6/2000 Kuo ..... 439/92
6,364,706 B1 * 4/2002 Ando et al. ..... 439/607.37
6,793,531 B1 * 9/2004 Zhang ..... 439/607.04
7,086,901 B2 * 8/2006 Zhang ..... 439/607.56
7,402,077 B2 * 7/2008 Shindo ..... 439/541.5
7,422,475 B2 * 9/2008 Hirata ..... 439/541.5
7,467,972 B2 * 12/2008 Long ..... 439/541.5
7,632,154 B1 * 12/2009 Su et al. ..... 439/660
2006/0166556 A1 * 7/2006 Hirata ..... 439/607
2009/0311907 A1 * 12/2009 Li ..... 439/607.01
2010/0041265 A1 * 2/2010 Wang ..... 439/353

* cited by examiner

*Primary Examiner*—James Harvey
(74) *Attorney, Agent, or Firm*—Rosenberg, Klein & Lee

(57) ABSTRACT

An electrical connector assembly of the invention comprises a butt plug with a contact portion and an electrical connector capable of matching the butt plug. One side of the contact portion has at least one engaging point. The electrical connector comprises an insulating body and a shield casing with at least one bottom wall. A side wall extends upward from at least one side of the bottom wall and the side wall covers at least one part of the insulating body. An opening, which is located at the front of the bottom wall and the side wall, is used for receiving the contact portion. The bottom wall has at least one fastening hole matching the engaging point. Enable the engaging point to slide into the corresponding fastening hole in parallel. When the butt plug is inserted into the shield casing once, the invention can ensure good electrical connection.

13 Claims, 9 Drawing Sheets

ELECTRICAL CONNECTOR ASSEMBLY

BACKGROUND OF THE INVENTION

1. Field of the Invention

The invention relates to an electrical connector assembly.

2. Description of the Prior Art

Please refer to FIG. 1. In the prior art, an electrical connector, which is capable of matching a butt plug 2, comprises an insulating body (not shown), a shield casing 1 for accommodating the insulating body, and a plurality of conductive terminals (not shown) accommodated in the insulating body. FIG. 1 is a perspective view illustrating the shield casing 1 of the electrical connector and the butt plug 2. The shield casing 1 comprises a top wall 10, a bottom wall 11, and two side walls 12. A first fastening hole 111 and a second fastening hole 112 are located in alignment at the bottom wall 11 and adjacent to the two side walls 12. Two pins 121 are respectively formed by punching the bottom wall 11 toward each side wall 12. The pins 121 extend downward from the side walls 12. After forming the pins 121, two punched holes 113 are formed on the bottom wall 11, wherein the two punched holes 113 are also in alignment and respectively in front of the first fastening hole 111 and the second fastening hole 112 in parallel.

The butt plug 2 comprises a main body 20 and a contact portion 21, wherein one side of the contact portion 21 has two flexible engaging points 210. To butt the butt plug 2 to the shield casing 1, the contact portion 21 of the butt plug 2 is inserted into the shield casing 1, the engaging points 210 firstly pass the two punched holes 113, so as to engage with the punched holes 113. Afterward, the engaging points 210 have to be further inserted to engage with the first fastening hole 111 and the second fastening hole 112. Consequently, a conducting plate (not shown) of the contact portion 21 is electrically connected to a terminal (not shown) of the electrical connector. However, when the engaging points 210 engage with the punched holes 113, it is easily for a user to mistake that the contact portion 21 has been butted with the terminal completely, and then the user will stop to push the butt plug 2 into the shield casing 1, such that the conducting pieces (not shown) of the contact portion 21 cannot fully contact the terminal (not shown) of the electrical connector. Accordingly, the electrical connection between the butt plug 2 and the electrical connector is unstable, so as to affect the performance and efficiency of the electrical connector.

Therefore, it is necessary to design a new electrical connector assembly to solve the aforesaid problems.

SUMMARY OF THE INVENTION

A scope of the invention is to provide an electrical connector assembly capable of enabling a butt plug to fully contact an electrical connector.

According to an embodiment, the electrical connector assembly comprises a butt plug with a contact portion and an electrical connector capable of matching the butt plug. One side of the contact portion has at least one engaging point. The electrical connector comprises an insulating body for accommodating a plurality of conductive terminals and a shield casing with at least one bottom wall. A side wall extends upward from at least one side of the bottom wall and the side wall covers at least one part of the insulating body. An opening, which is located at the front of the bottom wall and the side wall, is used for receiving the contact portion. The bottom wall has at least one fastening hole matching the engaging point. The side wall is punched to form at least one pin and at least one punched hole, wherein the punched hole is located between the opening and the fastening hole.

In the electrical connector assembly, the butt plug comprises the engaging points, the shield casing comprises the fastening holes corresponding to the engaging points, and the punched holes are located between the opening and the fastening holes, such that the engaging point can slide into the corresponding fastening hole in parallel. When the butt plug is inserted into the shield casing once, the invention can ensure good electrical connection without contact fault.

Another scope of the invention is to provide an electrical connector comprising an insulating body and a shield casing with at least one bottom wall. The insulating body accommodates a plurality of conductive terminals. A side wall extends upward from at least one side of the bottom wall, and the side wall covers at least one part of the insulating body. The side wall is punched to form at least one pin and at least one punched hole. The shield casing further comprises at least one fastening hole, wherein the fastening hole is located behind the punched hole, and the fastening hole is not located on the side wall.

In the electrical connector, the fastening holes of the shield casing and the punched holes are not on the same plane. When the electrical connector cooperates with a butt plug, the engaging points of the butt plug can slide into the fastening holes in parallel rather than fall into the punched holes. Accordingly, when the butt plug is inserted into the shield casing of the electrical connector once, the invention can ensure good electrical connection without contact fault.

Another scope of the invention is to provide a butt plug comprising a base portion, a contact portion and a control unit. The contact portion extends from the base portion, and one side of the contact portion has at least one engaging point. The control unit is used for controlling the engaging point.

In the butt plug, the engaging point can be controlled by the control unit, so as to prevent the shield casing of the electrical connector from being damaged by friction during connection.

The advantage and spirit of the invention may be understood by the following recitations together with the appended drawings.

BRIEF DESCRIPTION OF THE APPENDED DRAWINGS

DETAILED DESCRIPTION OF THE INVENTION

The advanced description with figures and embodiments is mentioned following.

Figure 1:
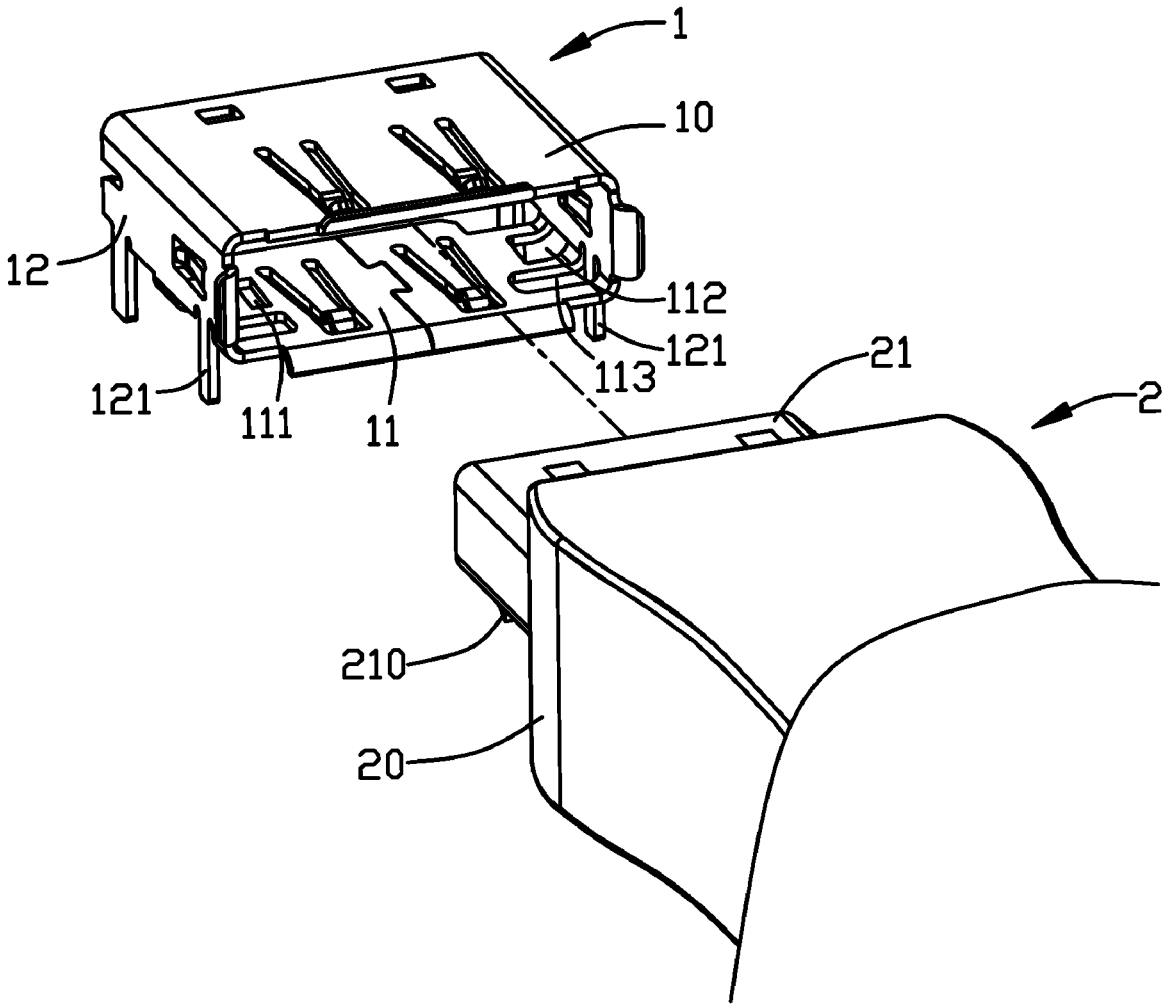
FIG. 1 (prior art)
FIG. 1 is a perspective view illustrating a shield casing of an electrical connector of prior art and a butt plug.
Figure 2:
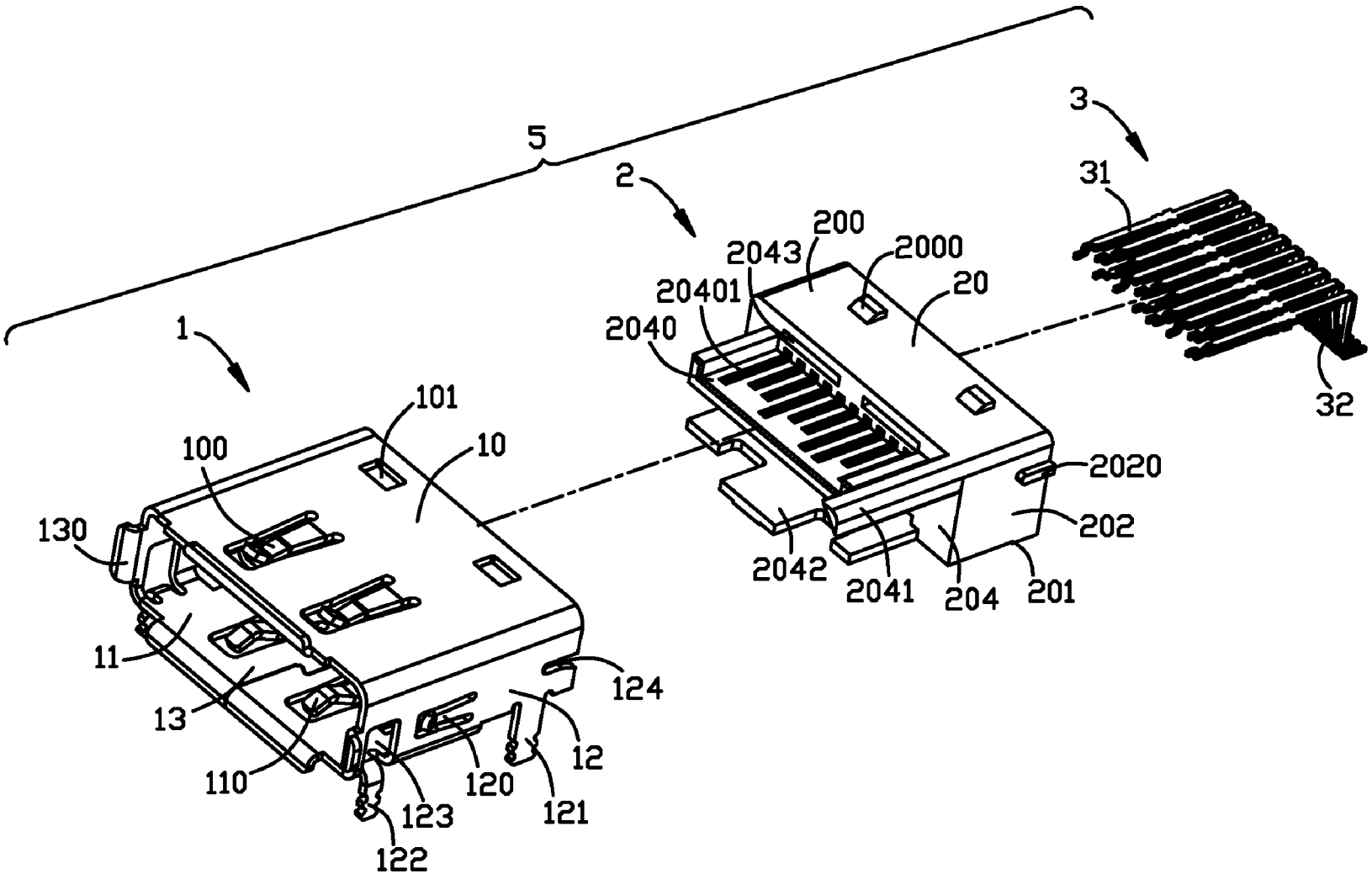
FIG. 2 is an exploded view illustrating an electrical connector assembly according to the invention.
Figure 3:
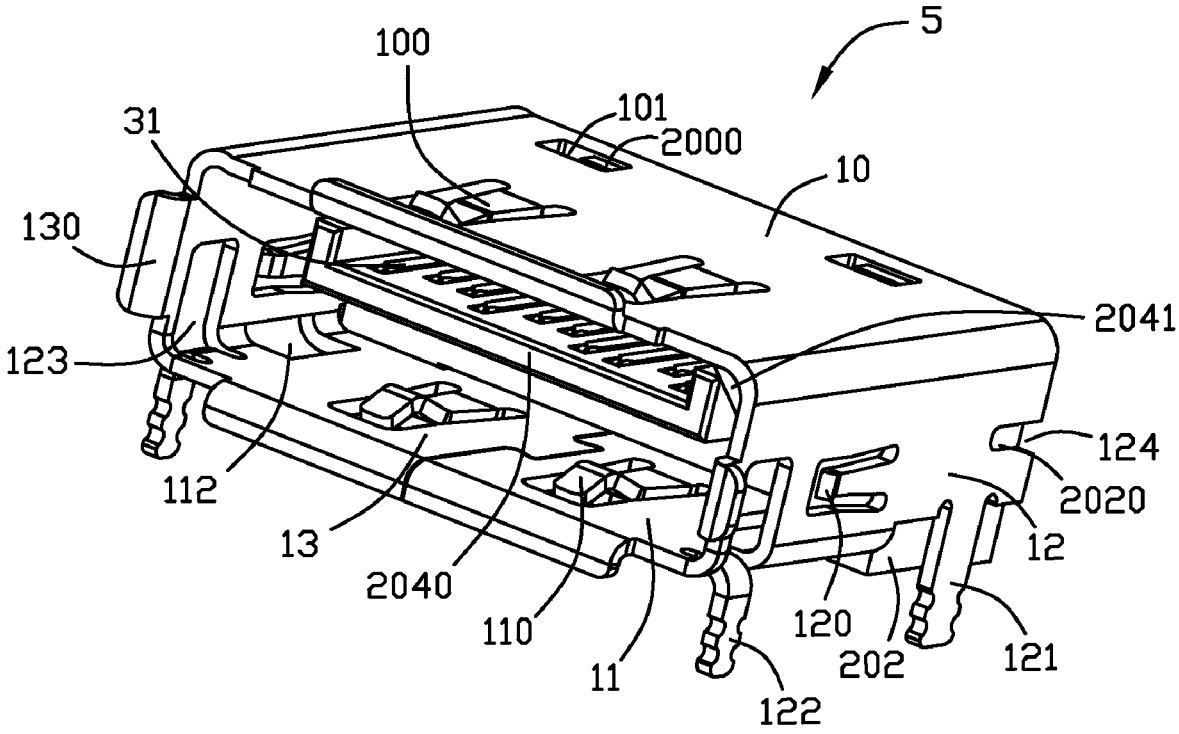
FIG. 3 is a perspective view illustrating the electrical connector shown in FIG. 2.
Figure 4:
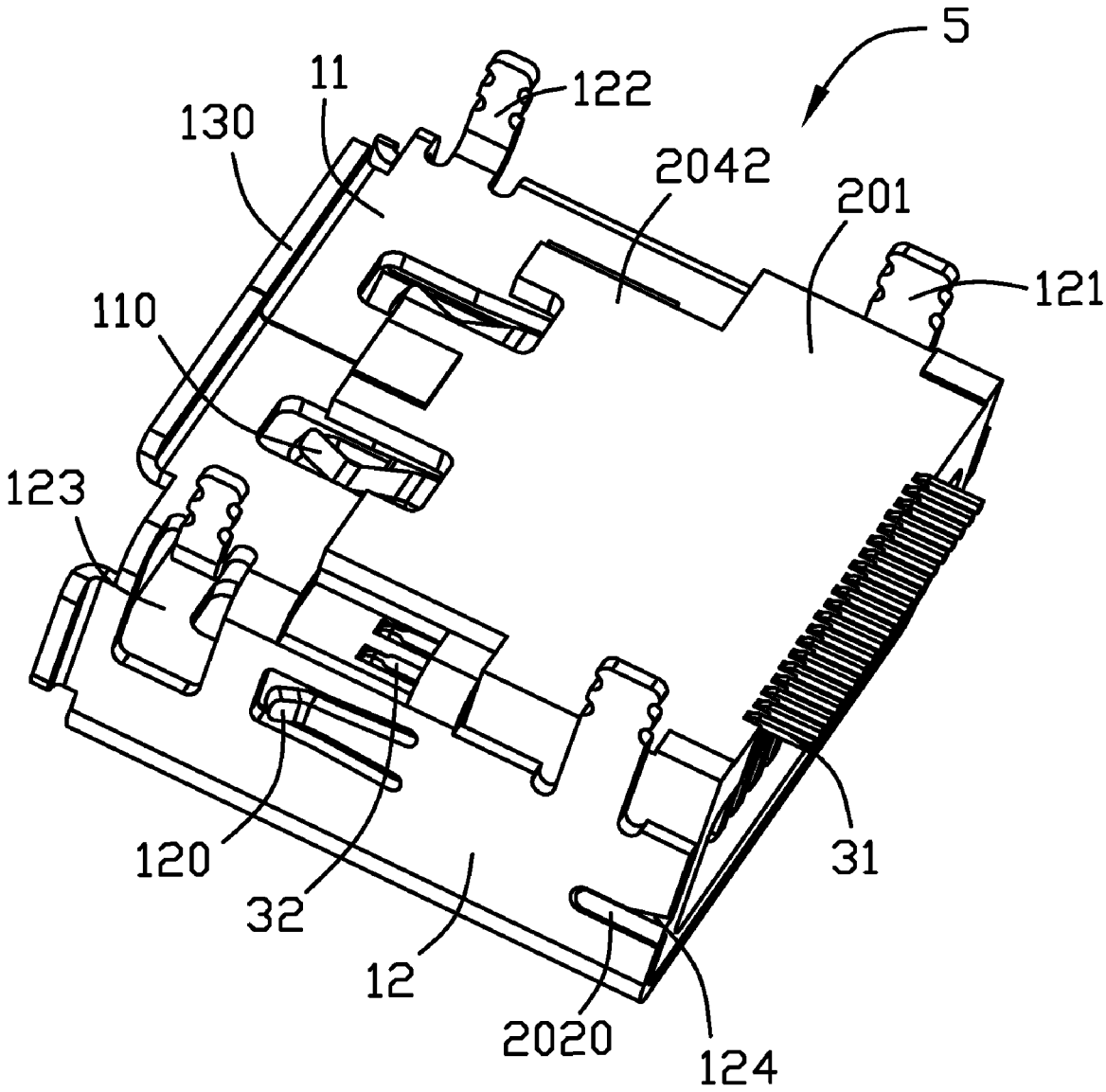
FIG. 4 is a perspective view illustrating the electrical connector shown in FIG. 2 based on another view angle.
Figure 9:
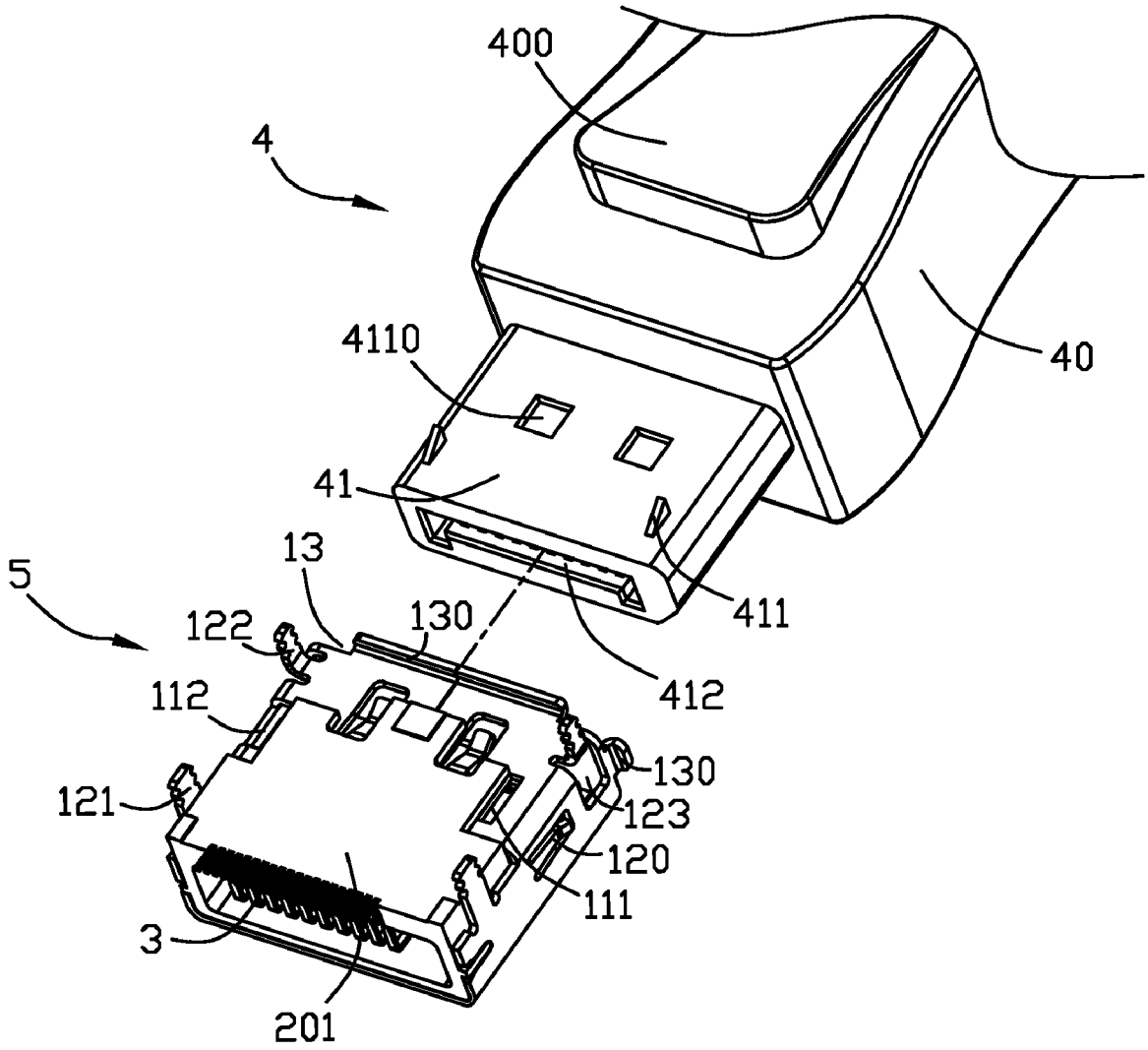
FIG. 9 is a perspective view illustrating the electrical connector and the butt plug shown in FIG. 2.

Please refer to FIG. 2, FIG. 3 and FIG. 9. An electrical connector assembly of the invention comprises an electrical connector 5 and a corresponding butt plug 4. The butt plug 4 comprises a base portion 40 and a contact portion 41, wherein one side of the contact portion 41 has two engaging points 411. The electrical connector 5 comprises an insulating body 2, a shield casing 1 and a plurality of conductive terminals 3. The plurality of conductive terminals 3 are accommodated within the insulating body 2. The shield casing 1 covers the insulating body 2 to prevent the electromagnetic interference.

Figure 5:
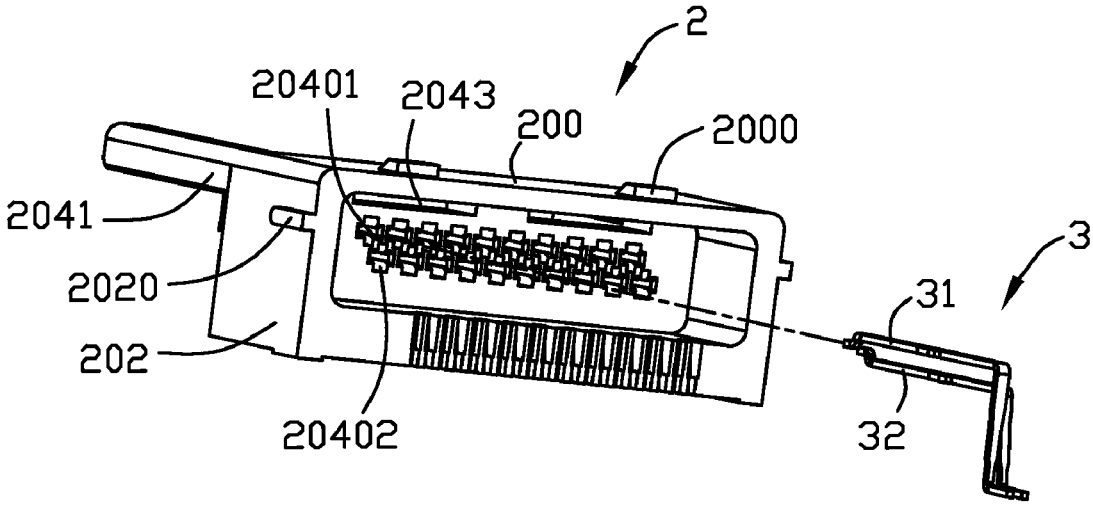
FIG. 5 is a perspective view illustrating an insulating body of the electrical connector and parts of terminals.
Figure 6:
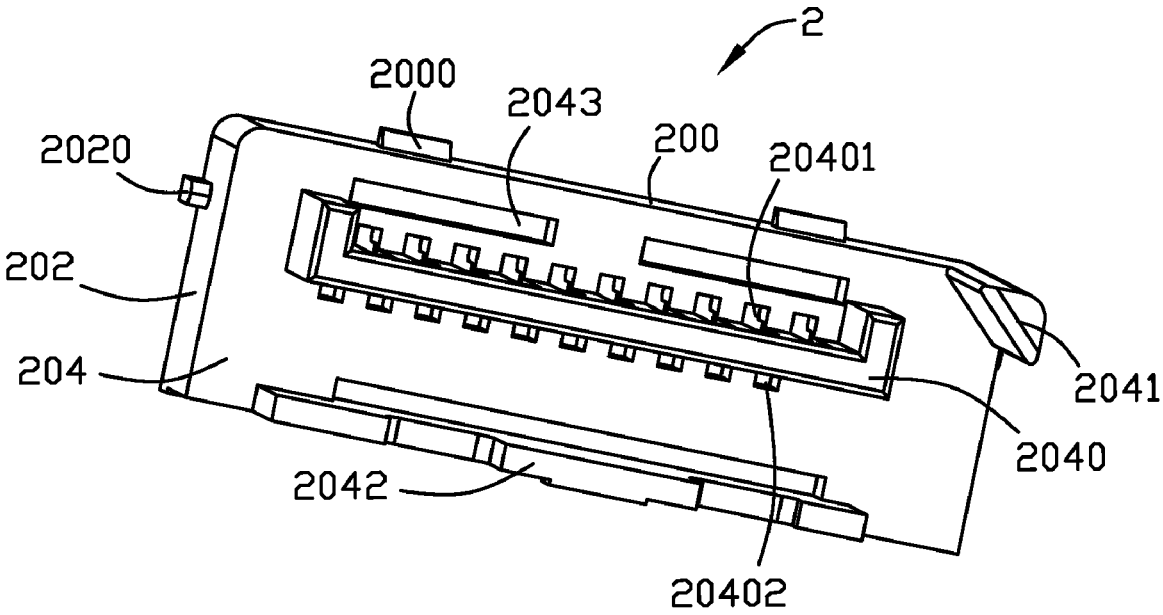
FIG. 6 is a perspective view illustrating the insulating body of the electrical connector shown in FIG. 2.

Please refer to FIG. 2, FIG. 5, and FIG. 6. The insulating body 2 has a main body 20. The main body 20 comprises a top plate 200, a bottom plate 201 and two side plates 202. Two identical positioning blocks 2000 are disposed on the top plate 200. Two engaging blocks 2020 respectively protrude from the two side plates 202 and are used to cooperate with the shield casing 1. The main body 20 further comprises a front surface 204 with two recesses 2043 formed thereon. A tongue plate 2040 is located below the two recesses 2043. A first row of terminal receiving recesses 20401 and a second row of terminal receiving recesses 20402 are formed through an upper wall and a lower wall of the tongue plate 2040, respectively, wherein the first row of terminal receiving recesses 20401 and the second row of terminal receiving recesses 20402 are used to receive and fix the plurality of conductive terminals 3. The front surface 204 of the main body 20 further comprises a long rib 2041. The rib 2041 is located above one side of the tongue plate 2040 and protrudes from one corner of the main body 20. A strengthened plate 2042 protrudes from the front surface 204 of the main body 20. Since the strengthened plate 2042 protrudes from the bottom plate 201 of the main body 20, the strengthened plate 2042 can strengthen the connection between the shield casing 1 and the insulating body 2.

Figure 7:
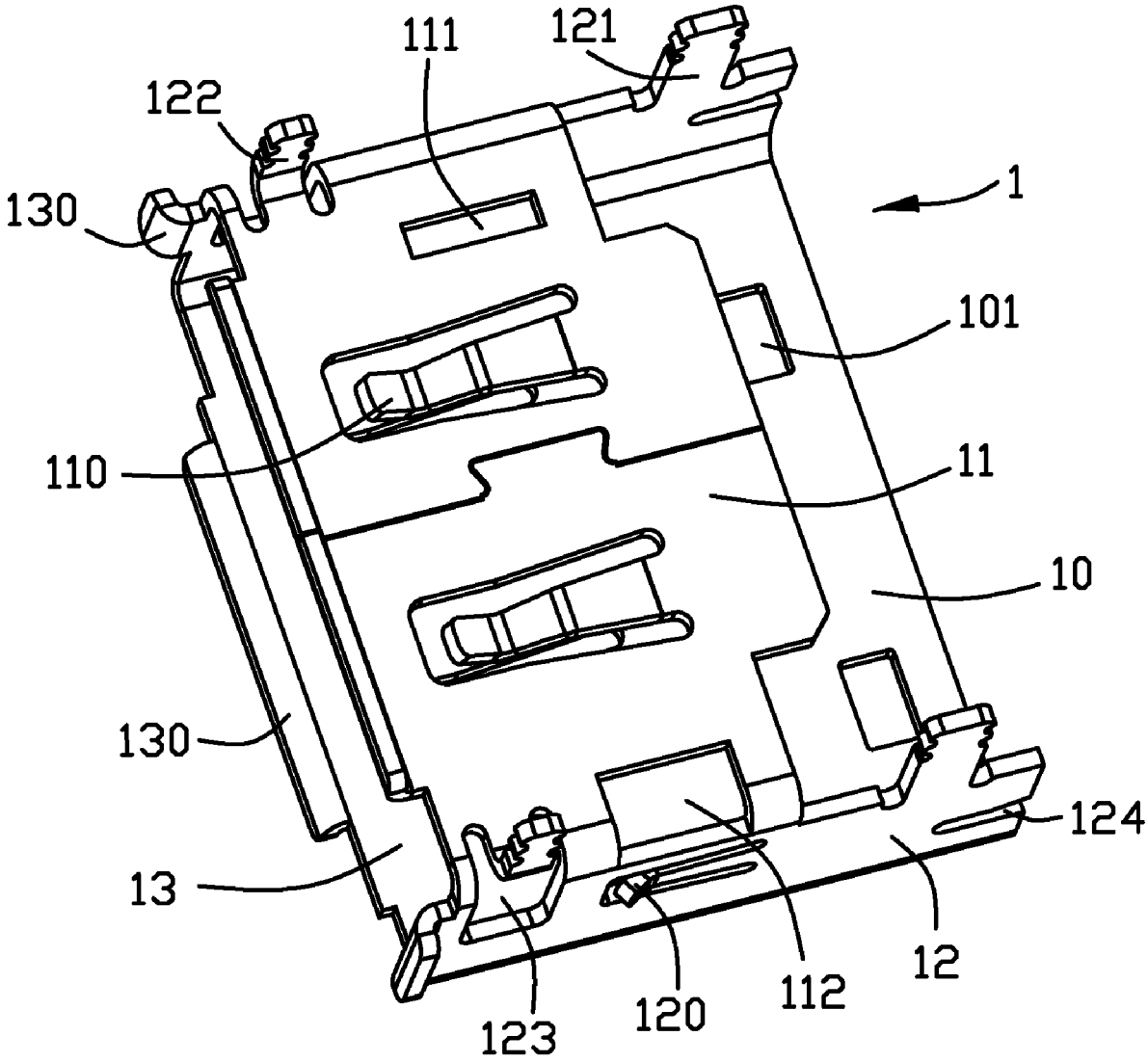
FIG. 7 is a perspective view illustrating the shield casing of the electrical connector shown in FIG. 2.
Figure 8:
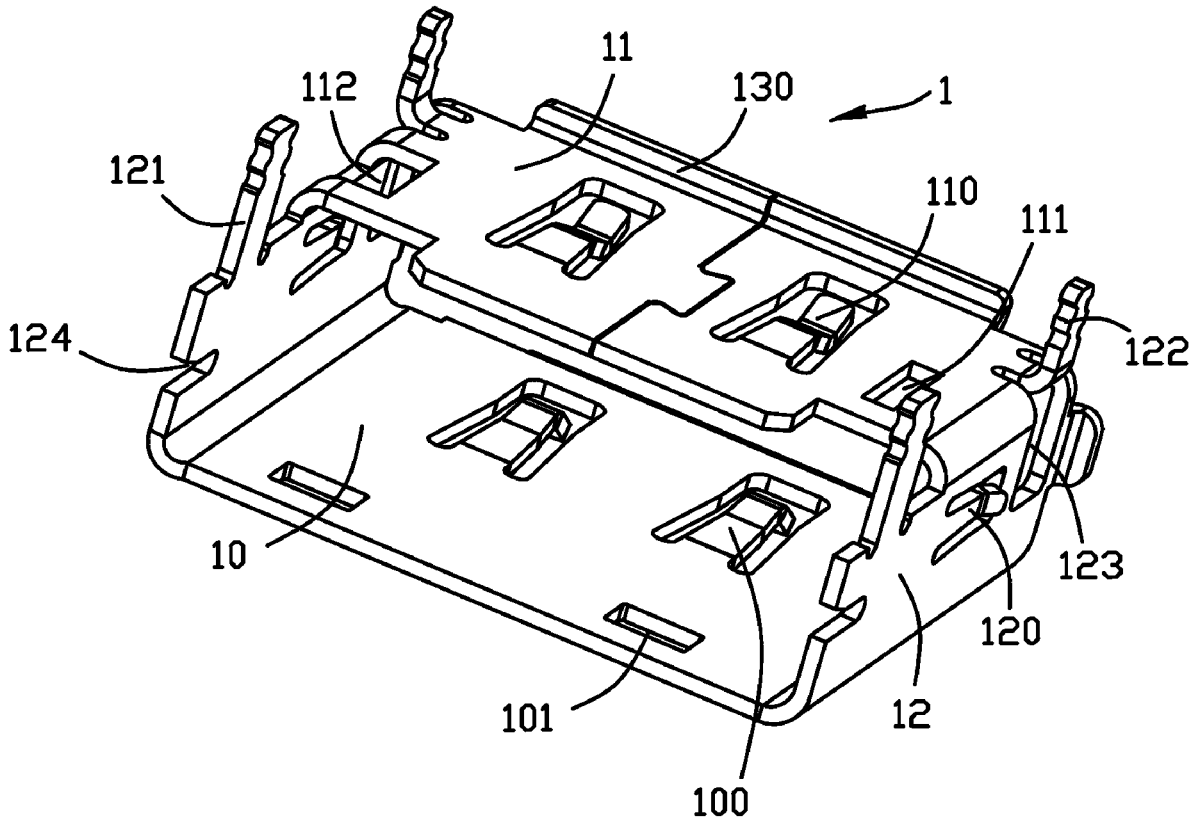
FIG. 8 is a perspective view illustrating the shield casing shown in FIG. 7 based on another view angle.

Please refer to FIG. 2, FIG. 7, and FIG. 8. The shield casing 1 comprises a top wall 10, a bottom wall 11 and two side walls 12. The front of the shield casing 1 comprises an opening 13 penetrating the back of the shield casing 1. Two guiding portions 130 are respectively extending from the end edges of the top wall 10 and bottom wall 11 near the opening 13, and the end edges of the two side walls 12 also extend to form two guiding portions 130. The guiding portions 130 can preferably guide the butt plug 4. Two first flexible plates 100 and two holes 101 are located on the top wall 10. The holes 101 can cooperate with the positioning blocks 2000 of the insulating body 2. Two second flexible plates 110 are located on the bottom wall 11. A first fastening hole 111 and a second fastening hole 112 are respectively located on the bottom wall 11 and adjacent to the two side walls 12. A distance is left between the first fastening hole 111 and the nearby side wall 12. The two second flexible plates 110 are between the second fastening hole 112 and the first fastening hole 111, and the second fastening hole 112 is closed to another side wall 12. The second fastening hole 112 is bigger than the first fastening hole 111, and the two fastening holes are in alignment. Each of the two side walls 12 comprises an identical third flexible plate 120 and a groove 124 capable of cooperating with the engaging block 2020 of the insulating body 2. Each of the two side walls 12 comprises a first pin 121, wherein the two first pins 121 are opposite to each other, located in alignment, and extend from the two side walls 12 downward to the bottom wall 11. Two second pins 122 are formed by punching the two side walls 12, respectively. Each of the second pins 122 is formed by punching the side wall 12 and then bended downward to the bottom wall 11. After forming the second pins 122, a punched hole 123 is formed on each of the side walls 12 and located between the opening 13 and the two fastening holes. All of the pins are welded to a printed circuit board (not shown).

In addition, on the bottom wall 11, a plurality of apertures are located between the opening 13 and the first fastening hole 111 or the second fastening hole 112, and each of the apertures must be smaller than the engaging points 411, such that the engaging point 411 can slide over the apertures rather than fall into the apertures. That is to say, the engaging point 411 is unaffected by the apertures when sliding over the bottom wall 11.

Please refer to FIG. 2 and FIG. 5. The conductive terminals 3 comprise a first set of conductive terminals 31 and a second set of conductive terminals 32. The conductive terminals 3 are accommodated and fixed within the insulating body 2.

Figure 10:
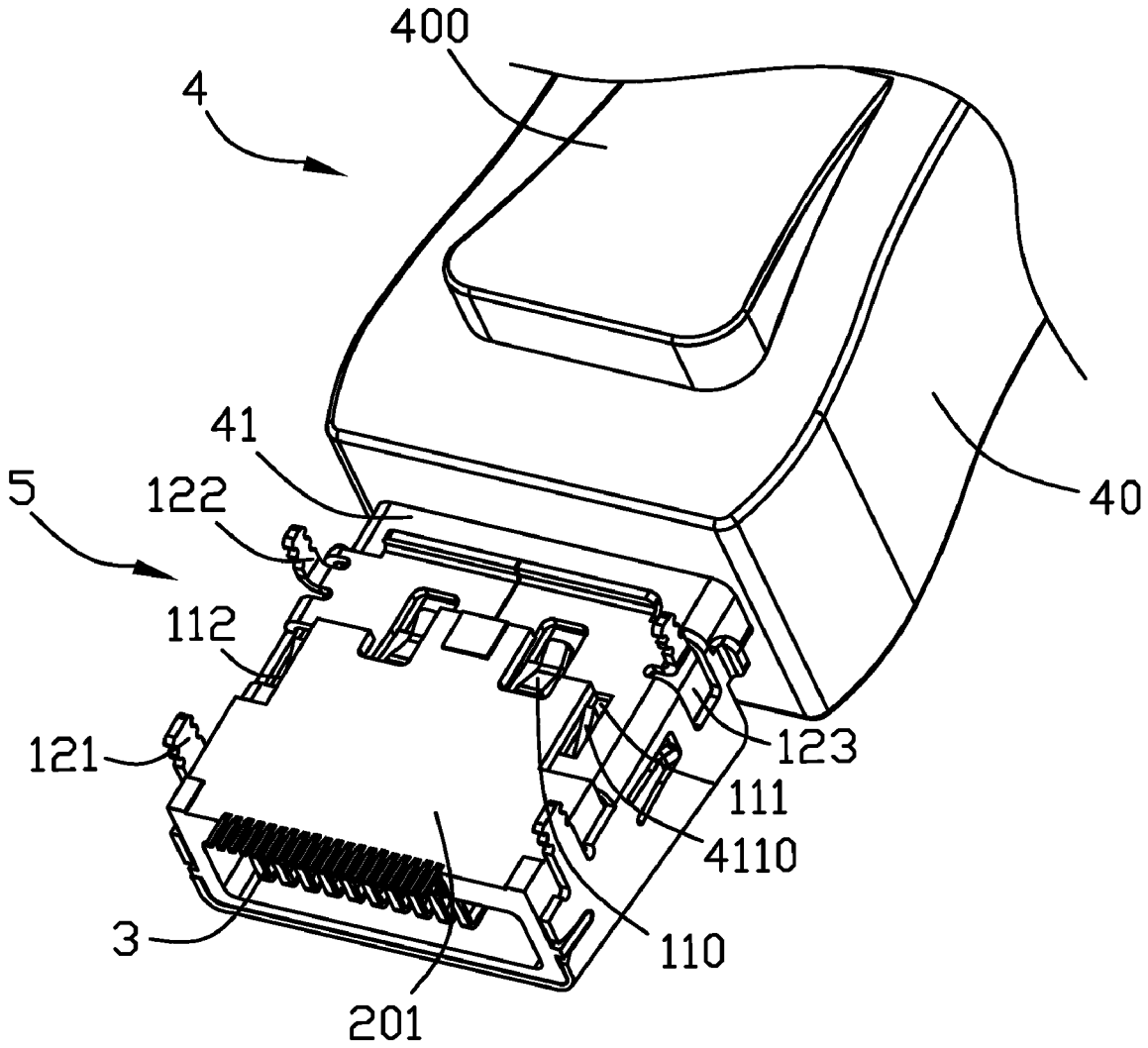
FIG. 10 is a perspective view illustrating the electrical connector connected with the butt plug shown in FIG. 9.

Please refer to FIG. 2, FIG. 9 and FIG. 10. FIG. 2, FIG. 9 and FIG. 10 are schematic diagrams illustrating the connection between the electrical connector 5 and the butt plug 4. The butt plug 4 comprises a base portion 40 and a contact portion 41 extending from the front of the base portion 40. The bottom surface of the base portion 40 has a control unit 400. The bottom surface of the contact portion 41 has two engaging points 411 arranged in alignment and controlled by the control unit 400. When pressing the control unit 400, the two engaging points 411 on the contact portion 41 will move flexibly. Two identical concave portions 4110 are located on the top and bottom surfaces of the contact portion. While connecting with the electrical connector 5, the first flexible plate 100 of the top wall 10 and the second flexible plate 110 of the bottom wall 11 are respectively against the concave portions 4110, so as to hold the contact portion 41 more firmly. Furthermore, the contact portion 41 has a space 412 for receiving the tongue plate 2040 of the insulating body 2, wherein the shape of the space 412 is corresponding to the tongue plate 2040, and the conducting pieces (not shown) within the space 412 can electrically contact the conductive terminals 3 on the tongue plate 2040.

Please refer to FIG. 3, FIG. 4, FIG. 5 and FIG. 6. While assembling, first of all, the first set of conductive terminals 31 are inserted into the first row of terminal receiving recesses 20401 in order, the second set of conductive terminals 32 are inserted into the second row of terminal receiving recesses 20402 in order, and the plurality of conductive terminals 3 are fixed.

Then, the insulating body 2 containing the plurality of conductive terminals 3 is placed into the shield casing 1 from the back thereof, such that the strengthened plate 2042 of the insulating body 2 is attached to the bottom surface of the bottom wall 11 of the shield casing 1. The tongue plate 2040 of the insulating body 2 stretches into the shield casing 1. The rib 2041 on the main body 20 is inserted in a corresponding corner of the shield casing 1 and closed to an inner wall of the shield casing 1. At this time, the positioning blocks 2000 of the insulating body 2 is fixed to the corresponding opening 101 of the shield casing 1. The engaging block 2020 is engaged with the groove 124 of the shield casing 1. Parts of the insulating body 2 are accommodated in the opening 13. Accordingly, the electrical connector 5 has been done.

Please refer to FIG. 9 and FIG. 10. When connecting the butt plug 4 and the electrical connector 5, the control unit 400 of the base portion 40 can be pressed down to make the engaging point 411 draw back toward the inner of the contact portion 41, and then the contact portion 41 is pushed into the electrical connector 5 through the opening 13. The tongue plate 2040 of the insulating body 2 is accommodated in the space 412 of the contact portion 41. The two engaging points 411 face the bottom wall 11 of the shield casing 1 and are pushed through the opening 13 to the two fastening holes. After feeling that the two engaging points 411 respectively fall into the first fastening hole 111 and the second fastening hole 112, the control unit 400 can be released. Afterward, the two engaging points 411 will jut out completely and get into the two fastening holes. Accordingly, the engaging points 411 of the contact portion 41 are respectively engaged with the first fastening hole 111 and the second fastening hole 112 of the shield casing 1. The electrical conducting pieces (not shown) within the space 412 electrically contact the conductive terminals 3 on the tongue plate 2040. The first flexible plate 100, the second flexible plate 110 and the third flexible plate 120 cooperate with each other to hold the contact portion 41. The rib 2041 of the insulating body 2 can prevent the butt plug 4 from being reversely inserted into the electrical connector 5, so as to perform function of fool-proofing.

The advantages of the invention are as follows:

The two pins 122 of the electrical connector are formed by punching, and then the punched holes 123 are formed on the two side walls 12. The first fastening hole 111 and the second fastening hole 112 are located on the bottom wall 11, and the two engaging points 411 face the bottom wall 11. The contact portion 41 of the butt plug 4 can be pushed through the opening 13 to the two fastening holes until the two engaging points 411 enter the first fastening hole 111 and the second fastening hole 112. Based on the aforesaid structure, the contact portion 41 can be once plugged to the appropriate position, so as to prevent the engaging points 210 of the prior art from falling into the punched hole 113 before reaching the designated location. Accordingly, unstable electrical connection caused by incomplete contact can be solved, and the performance and efficiency of the electrical connector are enhanced. In addition, a plurality of apertures can be located between the opening 13 and the first fastening hole 111 or the second fastening hole 112, and the apertures must be smaller than the engaging points 411. In other words, the engaging point 411 is unaffected by the apertures when sliding over the bottom wall 11. Under this circumstance, the aforesaid scope also can be achieved.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An electrical connector assembly comprising:

an electrical plug having a contact portion, one side of the contact portion having at least one hook tab;

an electrical connector for establishing electrical connection with the electrical plug, the electrical connector comprising:

an insulating body accommodating a plurality of conductive terminals, and a shield at least partially enclosing the insulating body, comprising: at least one bottom wall having at least one fastening hole engageable with the hook tab, a side wall extending upwardly from one side of the bottom wall, and an opening defined by the bottom wall and the side wall for receiving the contact portion of the electrical plug, the side wall being punched to form at least one mounting member and at least one punched hole, wherein the at least one punched hole locates nearer the opening than the fastening hole.

2. The electrical connector assembly of claim 1, wherein the hook tab engages or disengages with the fastening hole.

3. The electrical connector assembly of claim 1, wherein the mounting member comprises a first mounting foot and a second mounting foot.

4. The electrical connector assembly of claim 3, wherein the first mounting foot extends from the side wall of the shield, the second mounting foot extends from the bottom wall of the shield.

5. The electrical connector assembly of claim 1, wherein the hook tab faces the bottom wall and is inserted into the fastening hole through the opening.

6. The electrical connector assembly of claim 1, wherein the fastening hole comprises a first fastening hole and a second fastening hole.

7. The electrical connector assembly of claim 1, wherein the bottom wall between the opening and the fastening hole comprises at least one aperture smaller than the hook tab, and the hook tab is unaffected by the aperture while moving over the bottom wall.

8. An electrical connector for establishing electrical connection with a complementary plug having a locking tab, comprising:

an insulating body accommodating a plurality of conductive terminals, and a shield at least partially enclosing the insulating body, comprising: at least one bottom wall having at least one fastening hole engageable with the hook tab of the complementary plug, a side wall extending upwardly from at least one side of the bottom wall, the side wall being punched to form at least one mounting member and at least one punched hole located nearer the opening than the fastening hole.

9. The electrical connector of claim 8, wherein the mounting member comprises a first mounting foot and a second mounting foot.

10. The electrical connector of claim 9, wherein the second mounting foot is formed by punching the side wall.

11. The electrical connector of claim 8, wherein the shield further comprises a top wall, and an opening is defined by the top wall, the bottom wall and side walls.

12. The electrical connector of claim 8, wherein the locking tab faces the bottom wall and is insertable into the fastening hole through the opening.

13. The electrical connector of claim 12, wherein the bottom wall between the opening and the fastening hole comprises at least one aperture smaller than the locking tab, and the locking tab is unaffected by the aperture while moving over the bottom wall.

* * * * *